US005473802A

United States Patent [19]

Dilo

[11] Patent Number: 5,473,802

[45] Date of Patent: Dec. 12, 1995

[54] BRUSH ARRANGEMENT FOR A NEEDLE LOOM

[75] Inventor: Johann P. Dilo, Eberbach, Germany

[73] Assignee: Oskar Dilo Maschinenfabrik KG, Eberbach, Germany

[21] Appl. No.: 158,925

[22] Filed: Nov. 29, 1993

[30] Foreign Application Priority Data

Jan. 21, 1993 [DE] Germany ..... 43 01 572.7

[51] Int. Cl.[6] ..... D04H 1/46

[52] U.S. Cl. ..... 28/107

[58] Field of Search ..... 198/803.14, 803.15; 28/105, 106, 107, 111, 115, 108, 109, 110, 113, 114; 15/191.1, 192, 193, 194, 195, 196, 197, 207.2

[56] References Cited

U.S. PATENT DOCUMENTS 4,617,695 10/1986 Amos et al. ..... 15/195
4,651,393 3/1987 Dilo et al. ..... 28/107
5,117,541 6/1992 Leuchtenmüeller ..... 28/115
5,144,730 9/1992 Dilo ..... 28/109

FOREIGN PATENT DOCUMENTS 3404150 8/1985 Germany ..... 15/195

*Primary Examiner*—Clifford D. Crowder
*Assistant Examiner*—Larry D. Worrell, Jr.
*Attorney, Agent, or Firm*—Rosen, Dainow & Jacobs

[57] ABSTRACT

A brush structure for use as a stitch support for a velour needle loom comprises bristle tufts inserted into a carrier plate, with their free ends forming a continuous support surface for supporting thereon a fiber batt to be needled. The foot portions of the bristle tufts are of polygonal cross-section, resulting in a high packing density of the bristle tufts on the carrier plate and optimum bristle-coverage thereof. This enables excellent continuity of the support surface formed by the free bristle ends to be achieved without the bristles having to be provided with a curl or crimp.

21 Claims, 3 Drawing Sheets

BRUSH ARRANGEMENT FOR A NEEDLE LOOM

FIELD OF THE INVENTION

The invention relates to a brush structure for a needling loom in which it serves as a base for supporting thereon a fiber batt to be needled.

RELATED PRIOR ART

Needling looms in which the support base consists of an endless brush belt set with numerous bristles are employed as velour needling looms corresponding to U.S. Pat. No. 4,651,393. The brush structures employed in these machines consist of a plurality of closely adjacent carrier plates in which the bristles are retained in the form of separate tufts. Each carrier plate is formed with numerous round pockets arranged in a regular pattern and in which the foot portions of the bristle tufts are retained. The individual bristles of the bristle tufts are curled, causing the tufts to expand above their foot portions retained in the carrier plate, so that their free ends form a continuous and uniformly load-supporting surface for carrying thereon the fiber batt to be needled.

SUMMARY OF THE INVENTION

It is an object of the invention to provide a brush structure for a needle loom, which exhibits high stability for supporting the fiber batt with optimum uniformity to thereby result in a highly uniform pile formation on the fiber batt being processed while resting on the brush structure.

This object is attained by the provision of a brush structure for a needle loom, in which the brush structure is used for supporting a fiber batt to be needled, and comprising a carrier plate having two sides and a plurality of bristle tufts each formed of numerous bristles and having a first end portion devised as a foot portion embedded and secured in one side of said carrier plate, and a second end portion devised as a head portion having a free end, the free ends of said head portions of all bristle tufts being substantially disposed in a common plane and cooperating to define a support surface for a fiber batt to be supported thereon, and the foot portions of said bristle tufts being of polygonal cross-sectional configuration with sides extending parallel to and at equal distances from respective sides of the foot portions of adjacent bristle tufts.

The novel brush structure with polygonal cross-sectional shape of the pockets retaining the bristle tufts may selectively comprise curled or non-curled bristles, with the pockets being selectively of conical or prismatic shape in longitudinal section. Conical pockets in the carrier plate may permit the curling of the bristles to be totally dispensed with, or at least result in reducing adverse effects of irregularities in the curling of the bristles.

The invention is based on the perception that the circular cross-section of the bristle tufts at their foot portion is an important factor contributing to irregularities in the support surface formed by the bristle ends. The circular cross-section of the foot portions of the bristle tufts results in irregular distances between individual bristles at the periphery of a bristle tuft, these bristles cooperating with bristles at the periphery of adjacent bristle tufts to fill the gusset-shaped voids between adjacent bristle tufts.

The invention therefore proposes that the foot portions of the bristle tufts be given a polygonal cross-sectional shape permitting the peripheral bristles of adjacent bristle tufts to be evenly spaced. This alone is sufficient to ensure that irregularities in the aspect of the support surface formed by the bristle ends are avoided. Further improvements may be obtained by suitably shaping the foot portions of the bristle tufts to result in a more or less oblique orientation of the bristles within a tuft, to thereby progressively and uniformly fill the spaces between adjacent bristle tufts from their foot portions up to their free ends. The curling of the bristles is then no longer overly critical for this purpose, and may even be dispensed with.

The oblique orientation of the bristles, particularly in the peripheral zone of a bristle tuft, may be achieved by the bristles being curled or by a suitable configuration of the pockets in the carrier plate whereinto the foot portions of the bristle tufts are inserted. These pockets may be of a conically diverging or converging shape, resulting in a corresponding oblique orientation of the bristles in the bristle tuft retained therein. The term oblique orientation in this context indicates an inclination of the bristles relative to the perpendicular on the carrier plate.

In the case of pockets having square cross-sectional shape, only two facing walls thereof have to be inclined relative to one another so as to define a trapezoidal shape of the pocket in longitudinal section. The other two walls may extend parallel to one another, in which case the inclined walls are disposed to face parallel walls of adjacent pockets. Alternatively all of the four walls of a pocket may be obliquely oriented.

The polygonal configuration of the foot portions of the bristle tufts results in a considerably higher bristle density on the carrier plate than would be possible in the case of bristle tufts with foot portions of round cross-sectional shape, i.e. with the carrier plates being provided with round pockets for receiving the bristle tufts therein. This incresed bristle density results in higher uniformity of the appearance of the support surface for the fiber batt to be needled as formed by the bristle ends.

The described pockets may be of a shape widening towards their free rims, or they may be of a narrowing shape starting from their bottom towards the rim of their opening. in both cases the inclination of the pocket walls determines the more or less oblique orientation of the individual bristles of the respective tuft.

When the brush structure is required to have the same stability as a known brush with bristle tufts of round cross-sectional shape, the invention permits this to be achieved with brushes the bristle tufts of which are of greater length or composed of finer bristles than the known bristle tufts of round cross-section.

BRIEF DESCRIPTION OF THE DRAWINGS

Embodiments of the invention shall now be described in more detail by way of example with reference to the accompanying drawings, wherein.

EXPLANATION OF THE INVENTION

Figure 1:
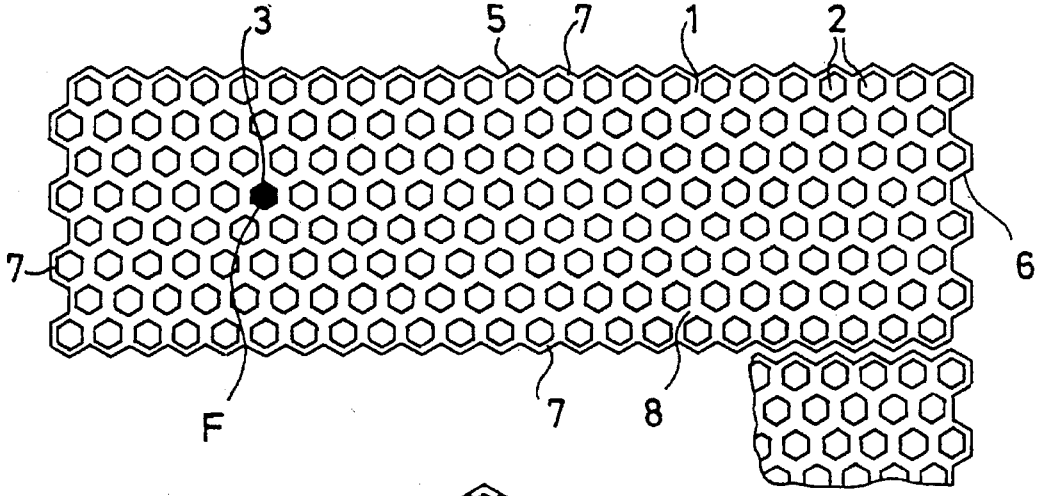
FIG. 1 shows a top plan view of an individual brush module with a brush structure according to the invention.
Figure 2:
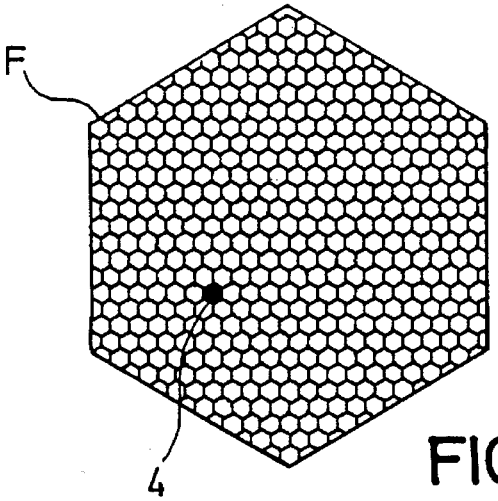
FIG. 2 shows a detail of FIG. 1 illustrating the shape of the bristles.

Shown in FIG. 1 is a first embodiment of a brush module incorporating the characteristics of the invention, comprising a carrier plate 1 formed with a plurality of pockets 2 having hexagonal cross-sectional shape, with bristle tufts 3 (FIG. 3) inserted therein, one such tuft being blackened out in FIG. 1 for emphasis. As shown by the illustration of the foot portion of a bristle tuft 3 in FIG. 2, the bristles 4 of the bristle tuft 3 are of substantially hexagonal cross-sectional shape, resulting in a very dense packing of the bristles 4 at their foot portion F in pocket 2. It is of course also possible to employ bristles of round cross-section. The gaps remaining between the foot portions of adjacent bristles may be closed with a filler mass if so desired. As illustrated in FIG. 1, the pockets 2 approximately define a honeycomb structure, resulting in equal spacings between the walls of adjacent pockets.

Figure 3:
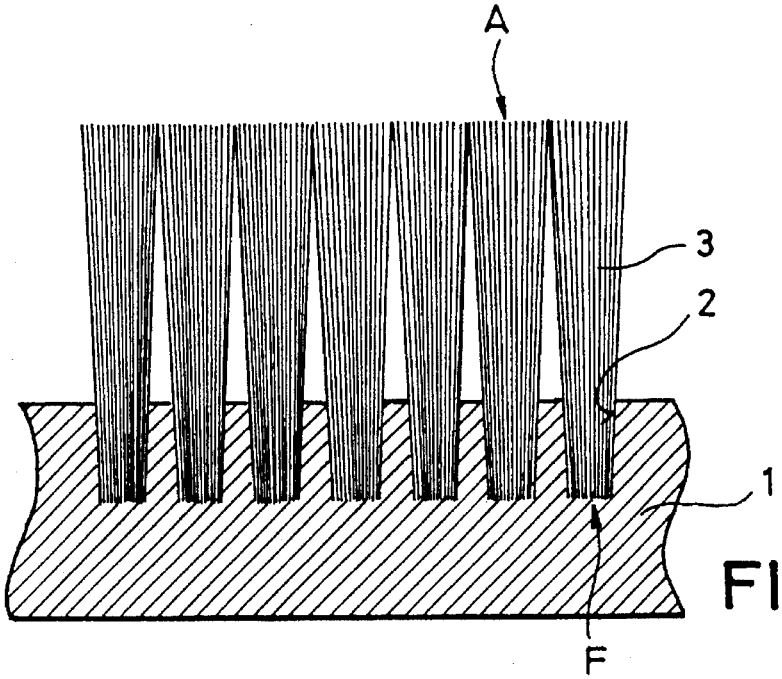
FIG. 3 shows a longitudinally sectioned view of part of the brush structure.

As shown by the longitudinally sectioned view in FIG. 3, the bristle tufts 3 are of a shape widening from their foot portions F towards their free ends. This widening shape is brought about by a corresponding cross-sectional configuration of the pockets 2 receiving the foot portions F of the bristle tufts. In the actual case the cross-section of the pockets 2 widens from the bottom towards the pocket rim. The widening of the cross-sections of the bristle tufts 3 in the manner shown in FIG. 3 results in that the free ends of the bristles 4 define a continuous support surface A for a fiber batt to be needled, without any remaining gaps. This effect is obtained without the necessity of the individual bristles 4 of the bristle tuft 3 to be provided with a curl. This fact results in that the individual bristles 4 are of a higher stability than if they were curled. This higher stability is conducive to better results of the needling process.

Also shown in FIG. 1 are crenellated or zig-zag-shaped sidewalls 5 and 6 of the brush module. This configuration is devised so that the carrier plates of adjacent brush modules can be meshed with one another as shown by the detail at lower right in FIG. 1, as a result of which the spacings between adjacent bristle tufts 3 belonging to two different brush modules are exactly the same as the spacing between two adjacent bristle tufts 3 located on one and the same carrier plate 1. To permit these equal spacings to be obtained, the walls 7 between the pockets 2 at the boundaries of the carrier plate 1 and the outer face of the latter are only half as thick as the walls 8 between adjacent pockets 2 in one and the same carrier plate 1. At this point it has to be emphasized that the spacing, i.e. the zig-zag gap shown in the drawing between the carrier plates is merely intended to demonstrate the boundary between the two carrier plates and is therefore depicted with an exaggerated width.

The formation of an uninterrupted, continuous support surface A by the free bristle ends can also be achieved when the pockets retaining the foot portions of the bristle tufts 3 are widening towards their bottoms, so that the individual bristles are oriented in the manner of the flower stalks of a bouquet set in a bulgy vase.

Figure 4:
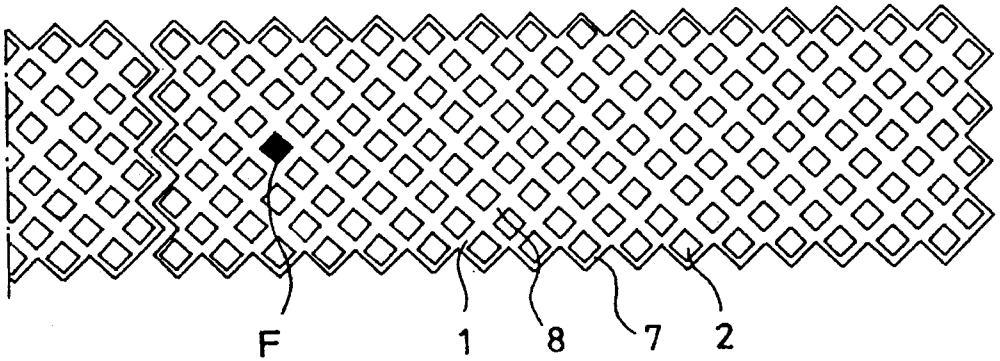
FIG. 4 shows a second embodiment of a brush structure with the characteristics according to the invention.
Figure 5A:
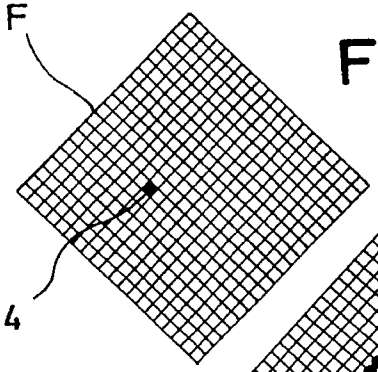
FIGS. 5*a* and 5*b* shows a detail of FIG. 4 illustrating two possible cross-sectional shapes of the bristles.
Figure 5B:
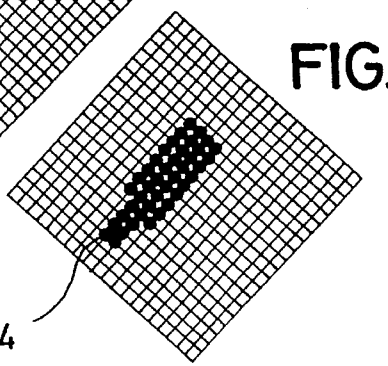

FIG. 4 shows an embodiment of the invention in which the foot portions F of bristle tufts 3 have a square cross-sectional shape. In this case, and as shown in FIG. 5*a*, the bristles 4 themselves are of square cross-sectional shape, although they may have a round cross-section as shown in FIG. 5*b* without disadvantageously resulting in the formation of voids within the bristle tuft. The periphery of the carrier plate 1 is again of a zig-zag configuration, with the walls 7 between peripheral pockets 2 and the outer face of the carrier plate being again half as thick as the walls 8 between adjacent pockets 2 in the carrier plate 1. In this embodiment the sectional configuration of the pockets may be devised so that all of the pocket walls are obliquely oriented, resulting in an aspect of the bristle tufts as shown in FIG. 3.

Figure 6:
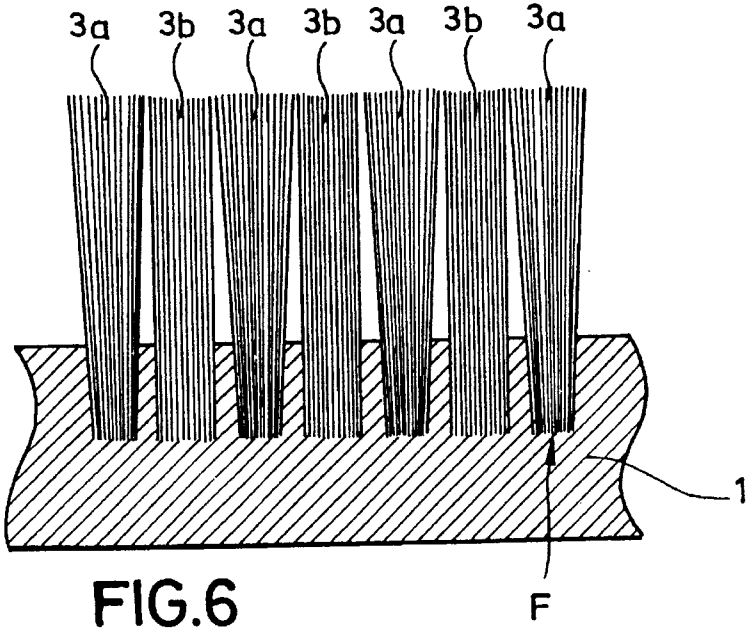
FIG. 6 shows a longitudinally sectioned view of an alternative embodiment of a brush structure as in FIG. 4.

Alternatively the configuration of the pockets may be selected such that only two facing walls are obliquely oriented and the other two walls extend parallel to one another, the obliquely oriented walls of one pocket being located adjacent a non-oblique wall of the next pocket. This arrangement results in a longitudinal-section appearance of the brush structure as depicted in FIG. 6. As shown in this figure, the bristle tufts 3*a* are of a divergent shape in the plane of section, widening from their foot portions F towards their free ends, while the bristle tufts 3*b* are of substantially constant width in this plane. A sectional view taken in a plane extending perpendicular to the plane of section of FIG. 6 would show substantially the same configuration, although with the difference that the bristle tufts 3*a* are of substantially constant width, while the bristle tufts 3*b* diverge from their foot portions towards their free ends.

Figure 7:
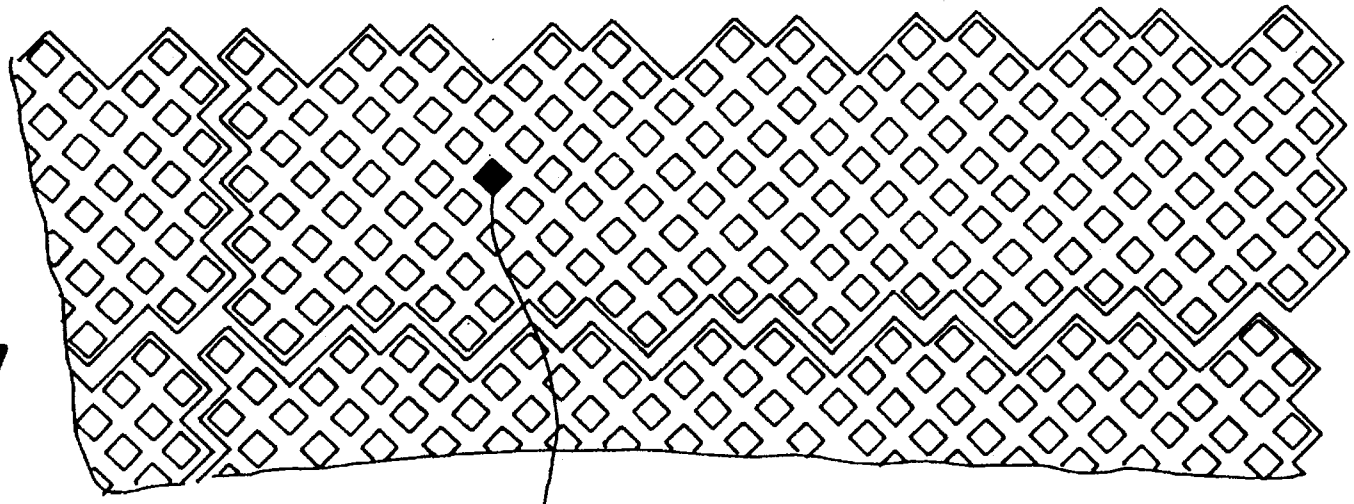
FIG. 7 shows an embodiment similar to FIG. 4 with a different configuration of the sidewalls of the brush module.

Shown in FIG. 7 is a brush module similar to the one illustrated in FIG. 4, with a modified configuration, however, of the boundaries of its carrier plate 1. In this embodiment the zig-zag profile of the longitudinal boundaries is of varying depth, with the boundaries on opposite sides being shaped complementary to one another so as to permit adjacent brush modules to be snugly fitted to one another. FIG. 7 illustrates a brush module together with parts of adjacent brush modules having identical boundary configurations. The brush module of FIG. 7 offers the particular advantage that the meshing zones between adjacent brush modules is of greater width both along their longitudinal boundaries and—when viewing two brush modules joined at their longitudinal boundaries—along their transverse boundaries, effective, in the case that in operation the brush modules fail to snugly abut one another due to the presence of play therebetween, to practically obliterate any irregularities in the stitch pattern of the needled fleece which might otherwise result therefrom. In the example shown, the width of this meshing zone corresponds to about 1.5 times the distance of two adjacent bristle tufts.

Figure 8:
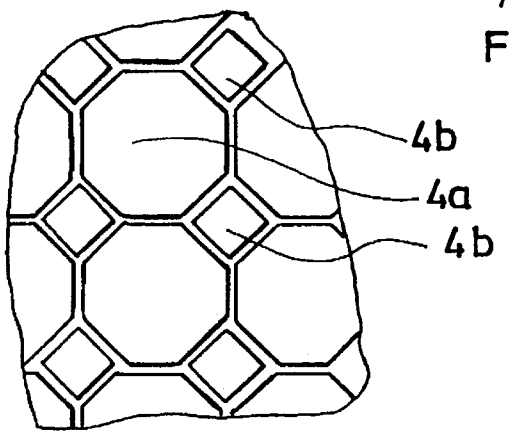
FIG. 8 shows an alternative pattern of pockets for receiving the bristle tufts therein.

FIG. 8 shows a composite polygonal pattern of the pockets in a carrier plate for the insertion thereinto of bristle tufts. This pattern comprises mutually adjacent pockets 4*a* of octogonal cross-section, with pockets 4*b* of square cross-section being formed in the spaces remaining therebetween. All of the pockets 4*a* and 4*b* have bristle tufts inserted thereinto. Also in this embodiment the boundaries of adjacent pockets extend close to one another over their full length, so that any voids are eliminated.

For the remainder, the brush modules are preferably configured and secured to a common mounting support in the manner described in the above-quoted EP 0 183 952 B 1, to be employed as a needling support in a needle loom in the form of an endless belt.

Figure 9:
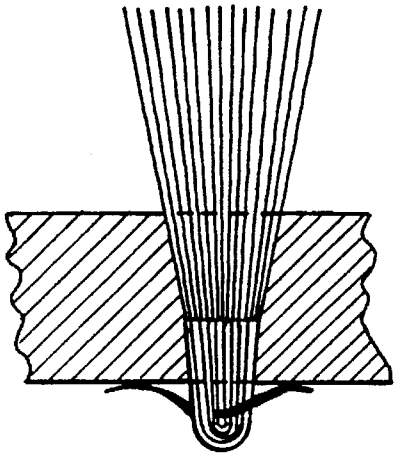
FIG. 9 shows in enlarged detail a per se known arrangement for securing the bristle tufts in the carrier plate.

The bristle tufts may be press-fitted, adhesively secured or fused to the carrier plates. It is also possible to secure the tufts in accordance with the conventional brush-makers technique, according to which the bristles are formed into loops and inserted into through-holes of the carrier plate, to be subsequently fixed thereto by a retaining wire passed through the bristle loop on the back face of the plate as illustrated by the detail shown in FIG. 9.

The carrier plates are preferably made of a plastic material with or without fiber reinforcement. The bristles may be pointed at their free ends to thereby facilitate the penetration of the needles between the bristles as a fiber batt is being needled.

I claim:

1. A needle loom brush for use in a needle loom in which said brush structure is employed for supporting a fiber batt to be needled, and comprising a carrier plate having two sides, and a plurality of bristle tufts each formed of numerous bristles and having a first end portion formed as a foot portion embedded in one side of said carrier plate and secure thereto, and a second end portion formed as a head portion having a free end, the free ends of said head portions of all bristle tufts being substantially disposed in a common plane and cooperating to define a support surface for a fiber batt to be supported thereon, and the foot portions of said bristle tufts being of polygonal cross-sectional configuration with sides extending parallel to and at equal distances from respective sides of the foot portions of adjacent bristle tufts.

2. A brush structure according to claim 1, wherein the cross-sectional configuration of said foot portions of said bristle tufts is triangular, rectangular, square or hexagonal or of composite polygonal shapes.

3. A brush structure according to claim 1, wherein said carrier plate is formed with pockets in which said foot portions of said bristle tufts are fixedly secured.

4. A brush structure according to claim 3, wherein said pockets are of prismatic shape.

5. A brush structure according to claim 1, wherein the cross-sectional area of said pockets diminishes along an axis of the pocket.

6. A brush structure according to claim 3, comprising pockets of polygonal cross-section with an even number of walls extending alternately parallel to a pocket axis and obliquely relative thereto.

7. A brush structure according to claim 6, comprising pockets of square cross-section defined by pocket walls, two mutually facing walls defining a trapezoidal shape of the pocket in longitudinal section, the walls of adjacent pockets extending adjacent said first-named walls cooperating with the facing walls of the respective pockets to define a rectangular shape of the respective pocket in longitudinal section.

8. A brush structure according to claim 3, wherein said pockets are blind holes having a bottom and a free rim, each of the walls of said pockets extending obliquely from the pocket bottom to its free rim to thereby widen the cross-section of the pocket in the direction towards the free rim.

9. A brush structure according to claim 3, wherein said pockets are blind holes having a bottom and a free rim, each of the walls of said pockets extending obliquely from the pocket bottom to its free rim so as to diminish the cross-section of the pocket in the direction towards the free rim.

10. A brush structure according to any of claims 1, 2, 3, 4, 5, 6, 7, 8, or 9, wherein said bristles are of polygonal cross-sectional shape at least at their foot portion, and are densely packed thereat for the elimination of voids.

11. A brush structure according to claim 3, wherein said bristles are of polygonal cross-sectional shape at least at their foot portions, and are densely packed thereat for the elimination of voids.

12. A brush structure according to claim 1, wherein said carrier plate is one of a plurality of equal carrier plates studded with bristle tufts and cooperating to form an endless brush belt, the individual carrier plates having their peripheral boundaries provided with a zig-zag configuration meshing with the zig-zag configuration of the peripheral boundaries of adjacent carrier plates, the zig-zag configuration being substantially matched to the cross-sectional pattern of the foot portions of said bristle tufts.

13. A brush structure according to claim 12, wherein said zig-zag configuration comprises a succession of projections in the plane of the plate, each projection projecting a distance different from the adjacent one.

14. A brush structure according to claim 2, wherein said carrier plate is formed with pockets in which said foot portions of said bristle tufts are fixedly secured.

15. A brush according to claim 14, wherein said pockets are of prismatic shape.

16. A brush according to claim 14, comprising pockets of polygonal cross-section with an even number of walls extending alternately parallel to a pocket axis and obliquely relative thereto.

17. A brush according to claim 14, comprising pockets of square cross-section defined by pocket walls, two mutually facing walls defining a trapezoidal shape of the pocket in longitudinal section, the walls of adjacent pockets extending adjacent said first-named walls cooperating with the facing walls of the respective pockets to define a rectangular shape of the respective pocket in longitudinal section.

18. A brush according to claim 14, wherein said pockets are blind holes having a bottom and a free rim, each of the walls of said pockets extending obliquely from the pocket bottom to its free rim to thereby widen the cross-section of the pocket in the direction towards the free rim.

19. A brush according to claim 14, wherein said pockets are blind holes having a bottom and a free rim, each of the walls of said pockets extending obliquely from the pocket bottom to its free rim so as to diminish the cross-section of the pocket in the direction towards the free rim.

20. A brush according to claim 14, wherein said bristles are of polygonal cross-sectional shape at least at their foot portions, and are densely packed thereat for the elimination of voids.

21. A device according to claim 1 wherein said polygonal cross-sectional configuration comprises a closed figure bounded by only essentially straight lines.

* * * * *